US007461665B2

(12) United States Patent
Koehn

(10) Patent No.: US 7,461,665 B2
(45) Date of Patent: Dec. 9, 2008

(54) SHADING APPARATUS

(76) Inventor: Ekkehard Koehn, 86 Waterview Ave., Wynnum, Queensland, 4178 (AU)

( * ) Notice: Subject to any disclaimer, the term of this patent is extended or adjusted under 35 U.S.C. 154(b) by 84 days.

(21) Appl. No.: 11/517,527

(22) Filed: Sep. 7, 2006

(65) Prior Publication Data

US 2007/0051396 A1 Mar. 8, 2007

(30) Foreign Application Priority Data

Sep. 7, 2005 (AU) ..... 2005904908

(51) Int. Cl.
*A45B 11/00* (2006.01)

(52) U.S. Cl. ..... 135/21; 135/98

(58) Field of Classification Search ..... 135/15.1, 135/20.1, 20.3, 21, 28, 97, 98; D25/121, D25/122, 124
See application file for complete search history.

(56) References Cited

U.S. PATENT DOCUMENTS

D213,613 S * 3/1969 Van Lautem ..... D25/122
5,116,258 A * 5/1992 Vennik ..... 135/20.3
D361,982 S * 9/1995 Rinderer ..... D13/155
5,927,310 A * 7/1999 Lin ..... 135/20.1
5,960,806 A * 10/1999 Steiner ..... 135/20.1
6,321,763 B1 * 11/2001 Ma ..... 135/20.1
6,619,306 B2 * 9/2003 Ma ..... 135/21
D487,936 S * 3/2004 Habeck et al. ..... D25/124
7,156,114 B2 * 1/2007 Lo ..... 135/21
2004/0154653 A1 * 8/2004 Brutsaert ..... 135/21
2007/0209688 A1 * 9/2007 Earnshaw ..... 135/16

* cited by examiner

*Primary Examiner*—David R Dunn
*Assistant Examiner*—Noah Chandler Hawk
(74) *Attorney, Agent, or Firm*—Abelman, Frayne & Schwab

(57) ABSTRACT

Shading apparatus including:

a standpost;

a plurality of boom members slidably mounted to said standpost and extending therefrom for movement therealong between selected positions; and a shade canopy mounted to each boom member.

7 Claims, 4 Drawing Sheets

SHADING APPARATUS

This invention relates to shading apparatus. The invention has particular application to shading apparatus of the type which have a stowable or collapsible canopy but it also may have application to apparatus having permanently erected canopies.

In one aspect the invention resides broadly in shading apparatus including:

a standpost;

a plurality of boom members slidably mounted to said standpost and extending therefrom for movement therealong between selected positions; and a shade canopy mounted to each boom member.

In another aspect the invention resides broadly in shading apparatus including:

a standpost having a centre portion and a plurality of tracks spaced around said centre portion and extending at least partially therealong;

at least one carriage mounted on each of said tracks for movement therealong between selected upper and lower positions;

a boom member mounted to said at least one carriage on each of said tracks for up and down movement therewith; and a shade canopy operatively connected to each boom member.

In another aspect the invention resides broadly in a standpost adapted to have a plurality of boom members mounted thereto for supporting shading apparatus at their outer ends, the standpost including:

a centre portion; and a plurality of tracks spaced around said centre portion and extending at least partially therealong, each track being adapted to support a carriage for up and down movement therealong and being defined by an inner guide and an outer guide adapted to retain therebetween a runner of the carriage to be supported by the track.

Preferably, said boom members are adapted to move through selected operative positions relative to said standpost from a first operative position in which the shade canopy assumes a steeply tilted shading position to a final operative position in which it assumes a level (or horizontal) shading position. Preferably, said boom members are adapted to move along said standpost independently of each other.

Preferably the apparatus includes drive means for driving movement of the boom members along the standpost. In a preferred form, the drive means are adapted to move the boom members independently of each other. In one such form, the drive means are cable winches and a separate winch is provided for each boom member. Such winches may be mounted on or in the standpipe for operating the respective boom members and may be hand actuated or electric motor actuated as required.

Preferably, said stand post is an extruded member with said tracks being contiguous with said centre portion. It is also preferred that said centre portion be hollow such that cables and rods for actuating said booms can be housed therein. In a preferred form, the apparatus includes two opposed boom members mounted to the standpost and for that purpose the standpost has two opposed tracks on which respective carriages may be mounted for supporting the opposed shade canopies.

The terms "upper', "lower", "vertical", "horizontal" and the like are used herein to for the purpose of describing the apparatus by reference to its normal in use attitude and are not intended to limit the apparatus to any particular orientation.

In order that the invention may be more easily understood and put into practical effect, the invention will now be described with reference to the accompanying drawings wherein.

Figure 1:
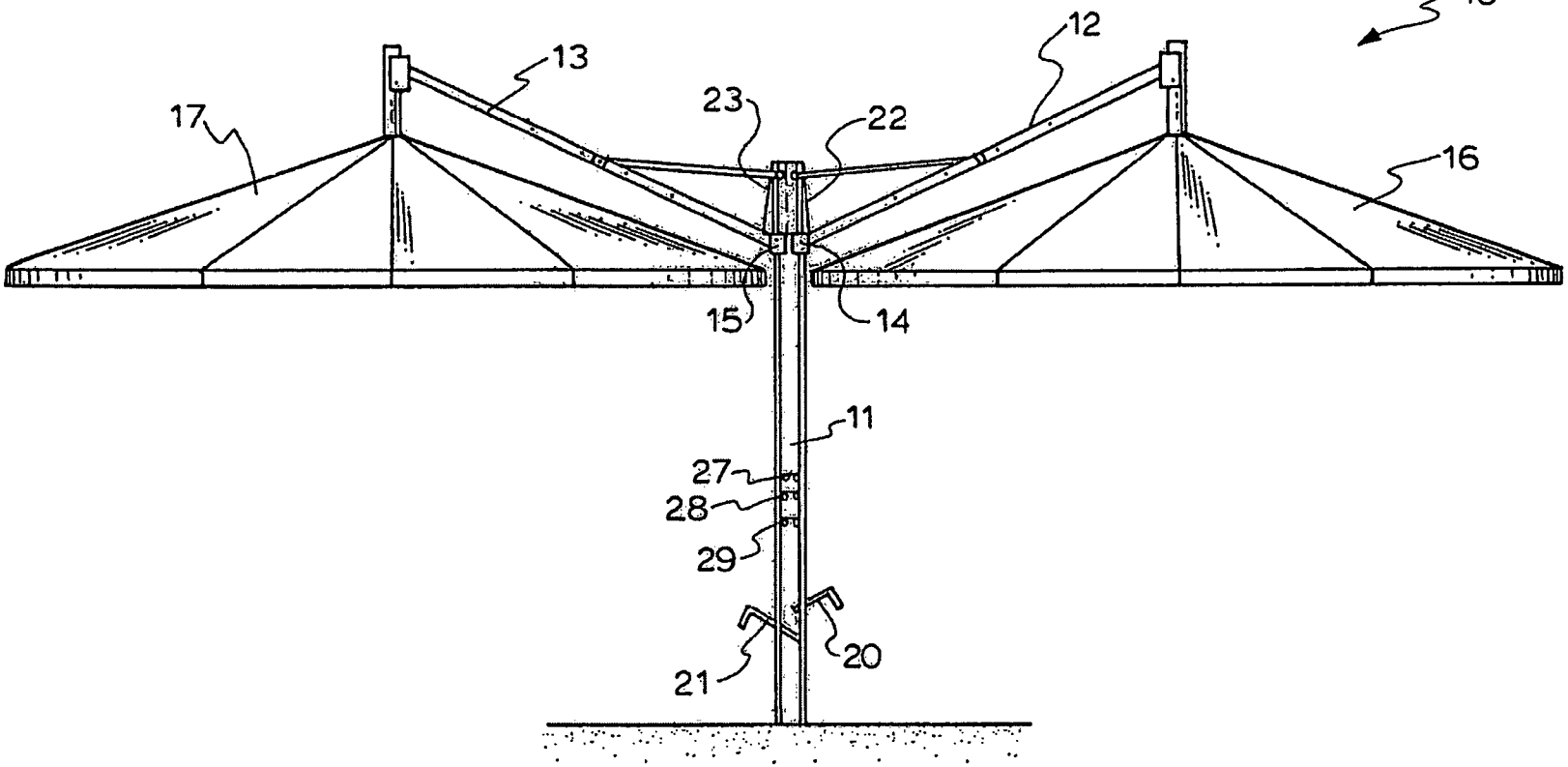
FIG. 1 is an elevation of shading apparatus with two canopies according to the present invention in the level (or horizontal) shading position.
Figure 4:
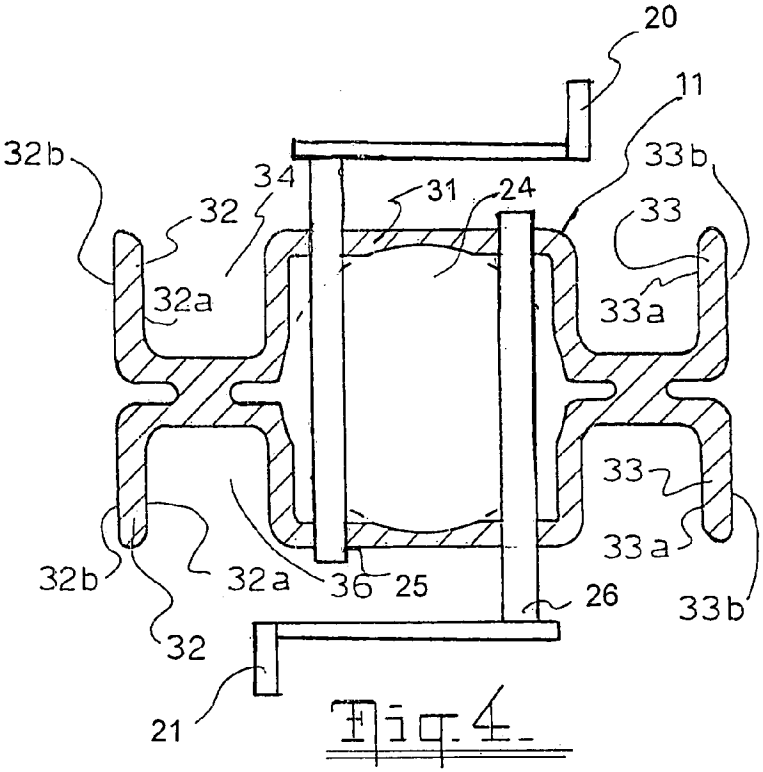
FIG. 4 is a sectional plan of the standpost of the apparatus of FIG. 1.
Figure 3:
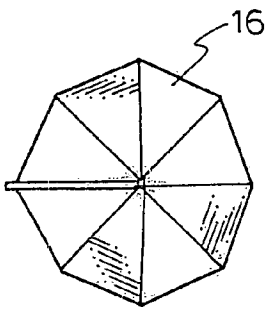
FIG. 3 is a plan view of one boom and canopy in the expanded and fully horizontal position.

The shading apparatus 10 illustrated in FIG. 1 includes a standpost 11 to which two opposed boom members 12 and 13 are mounted via carriages 14 and 15 at one end thereof while canopies 16 and 17 respectively depend therefrom at their other ends. Although the canopies are both shown in their horizontal shading positions in FIG. 1, the angle of tilt of each canopy can be changed by lowering the booms by sliding the carriages down the standpipe. For that purpose the carriages are pivotally connected to the respective booms and the crank handles 20, 21 are connected to the booms by cables 22 and 23 such that the booms can be raised and lowered by rotation of the crank handles. Advantageously, the booms can be raised or lowered independently of each other. Suitably, the cables 22, 23 pass through the centre passage 24 of the standpost and onto their respective crankshafts 25, 26 which pass horizontally through the standpost 11 and to which the crankhandles 20 and 21 attach, the cables 22, 23 and crankshafts 25, 26 constituting drive means for driving movement of the boom members 12 and 13 along the standpost 11.

Figure 2:
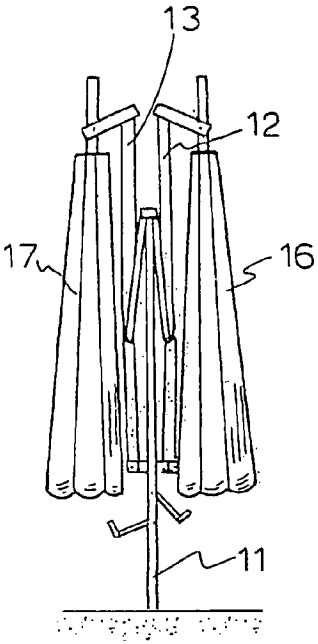
FIG. 2 is an elevation of the apparatus of FIG. 1 with the booms in the fully lowered position and the canopies in the stowed (or collapsed) position.

The booms are biased to the down position shown in FIG. 2 (with the canopies collapsed) but can be secured in the top position shown in FIG. 1 (with the canopies erected and in the level or horizontal shading position) or in any one of three preset intermediate tilted positions by locating a pin in any one of the apertures 27, 28 or 29 (one set of three apertures being provided for each boom) to secure the respective carriages in place once they have reached the desired position. The canopy is intended to remain erected while the boom is in any of those positions so that they can shade the desired area or act as wind breaks if required.

Figure 5:
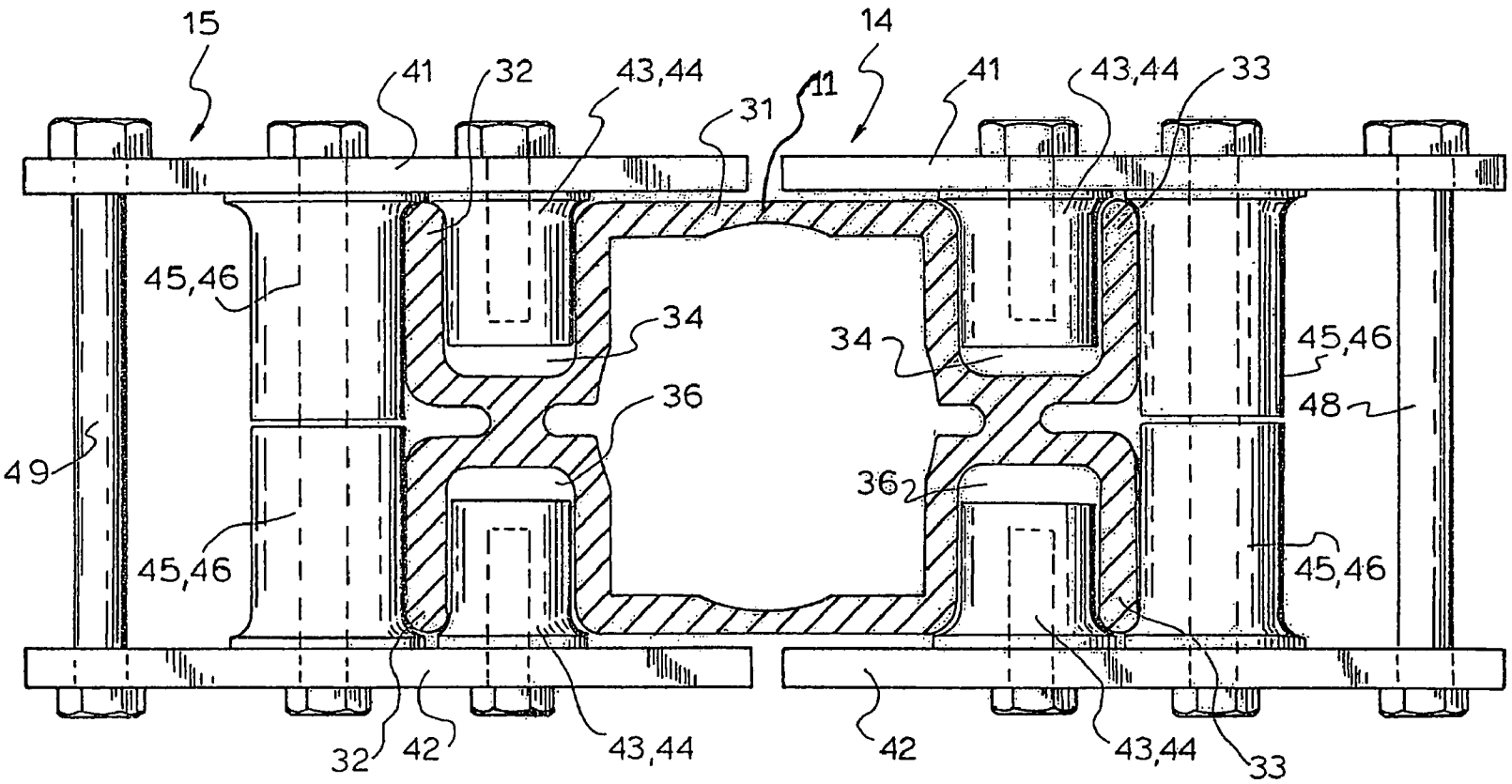
FIG. 5 is an expanded view of the standpost of FIG. 4 with two opposed carriages to which the respective booms are connected mounted thereon.

As can be more clearly seen in FIG. 5, the standpost has a substantially square hollow centre portion 31 and two opposed T-shaped portions 32 and 33 extending outwardly therefrom on opposite sides with the arms of one T having inner and outer faces 32*a* and 32*b* and the other having inner and outer faces 33*a* and 33*b* respectively. Each T-shaped portion together with the adjacent wall of the square centre portion defines opposed spaces 34 and 36 for securing the carriages to the standpost as will be described in more detail later.

Each carriage has spaced apart side plates 41 and 42 and upper and lower pairs of inner rollers 43 and 44 which are mounted to the respective side plates and protrude into the spaces 34 and 36 of the standpost while upper and lower pairs of outer rollers 45 and 46 also protrude from the respective side plates so as to run on the outer faces 32*b* and 33*b* of the T-shaped portions. The booms 12 and 13 are connected to the respective carriages 14 and 15 by mounting pins 48 and 49 extending between the two side plates and holding them together and apart so as to allow some pivoting movement of the booms as they raise and lower while held by the links 51 and 52 respectively.

Figure 6:
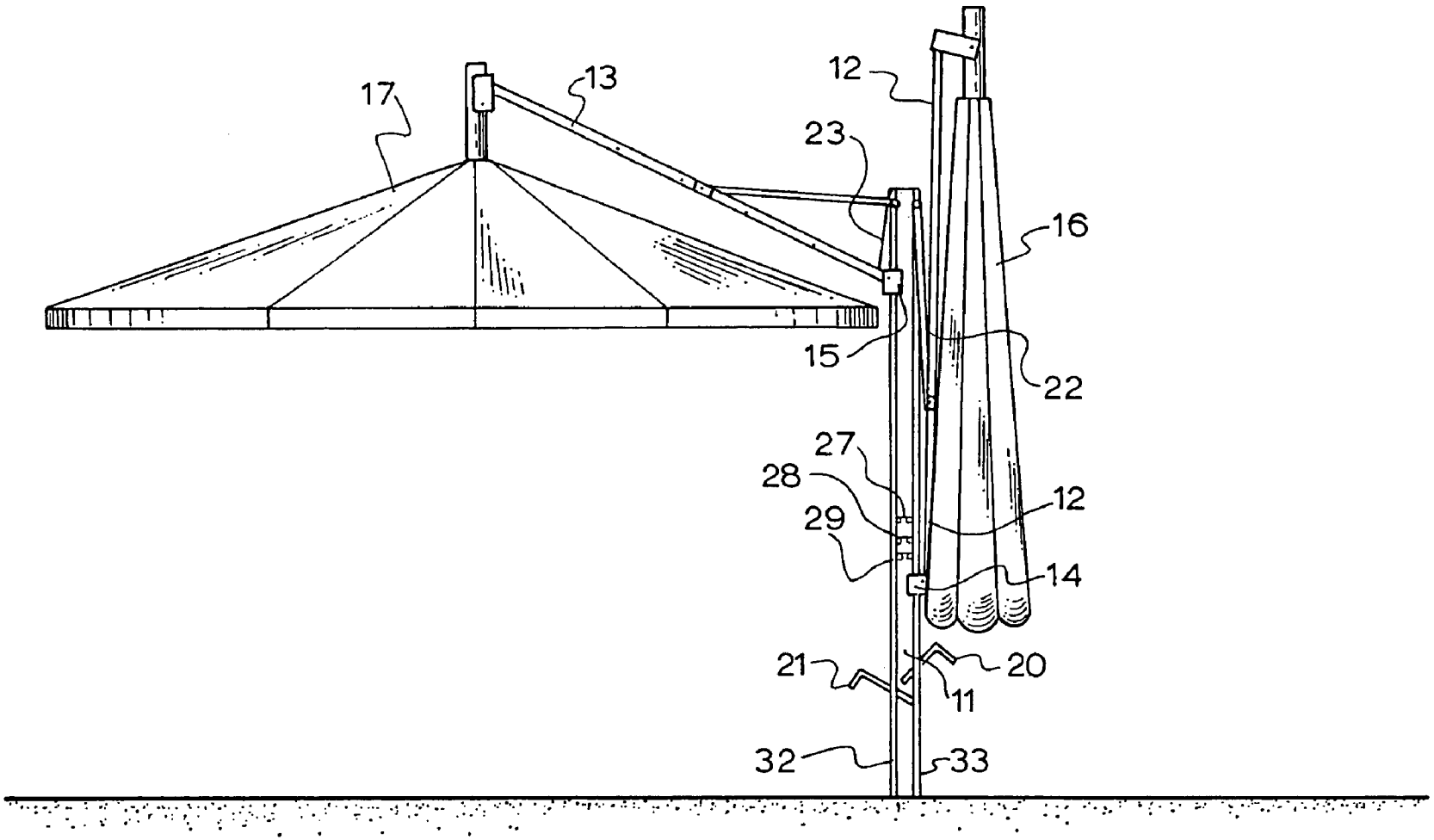
FIG. 6 depicts one canopy of the shading apparatus in the open position and one canopy in the closed position.

It will be appreciated from FIG. 6 that the carriages 14 and 15 and the respective booms attached thereto 12 and 13 may be raised and lowered along the standpost 11 independently by rotating their respective handles 20 and 21 as required.

It will be appreciated that the carriages and the respective booms attached thereto may be raised and lowered along the standpost independently by rotating their respective handles 20 and 21 as required.

While the foregoing description has been given by way of illustrative example of the invention, it will be understood that the invention may be embodied in many other forms and all such forms are deemed to fall within the broad scope and ambit of the invention as claimed in the appended claims.

The invention claimed is:

1. Shading apparatus including:

a standpost;

a plurality of boom members slidably mounted to said standpost and extending therefrom for movement therealong between selected positions;

a shade canopy mounted to each boom member wherein each said boom member is adapted to move through selected operative positions relative to said standpost from a first operative position in which the shade canopy mounted thereto assumes a stowed or collapsed position to a final operative position in which the shade canopy assumes a level shading position; and drive means for driving movement of the boom members along the standpost, said drive means being adapted to move the boom members independently of each other.

2. Shading apparatus according to claim 1, wherein said drive means includes a cable and crankshaft and a separate cable and crankshaft is provided for each boom member.

3. Shading apparatus including:

a standpost;

a plurality of boom members slidable mounted to said standpost and extending therefrom for movement therealong between selected positions;

a shade canopy mounted to each boom member wherein each said boom member is adapted to move through selected operative positions relative to said standpost from a first operative position in which the shade canopy mounted thereto assumes a steeply tilted shading position to a final operative position in which the shade canopy assumes a level shading position; and drive means for driving movement of the boom members along the standpost, said drive means including a separate cable and crankshaft for each boom member.

4. Shading apparatus including:

a standpost having a center portion and a plurality of tracks spaced around said center portion and extending at least partially therealong;

a plurality of boom members slidably mounted to said standpost and extending therefrom for movement therealong between selected positions;

a shade canopy mounted to each boom member;

a carriage mounted on each of said tracks for movement therealong between selected upper and lower positions, said carriages adapted to move along said standpost independently of each other; and each boom member being mounted to a carriage for up and down movement therewith along said standpost.

5. Shading apparatus according to claim 4, wherein said standpost is an extruded member and said tracks are contiguous with said centre portion.

6. Shading apparatus according to claim 5, wherein the centre portion is hollow.

7. Shading apparatus according to claim 4, wherein said plurality of boom members comprises two opposed boom members.

* * * * *